US009016491B2

(12) United States Patent
Blum et al.

(10) Patent No.: US 9,016,491 B2
(45) Date of Patent: Apr. 28, 2015

(54) COLLAPSIBLE CUP FOR HOT AND COLD BEVERAGES

(71) Applicants: Jason A. Blum, San Francisco, CA (US); John Adkins, San Ramon, CA (US); Scott Hart, Bonita, CA (US); Elise Kiland, Castro Valley, CA (US)

(72) Inventors: Jason A. Blum, San Francisco, CA (US); John Adkins, San Ramon, CA (US); Scott Hart, Bonita, CA (US); Elise Kiland, Castro Valley, CA (US)

( * ) Notice: Subject to any disclaimer, the term of this patent is extended or adjusted under 35 U.S.C. 154(b) by 0 days.

(21) Appl. No.: 14/275,820

(22) Filed: May 12, 2014

(65) Prior Publication Data

US 2014/0332528 A1 Nov. 13, 2014

Related U.S. Application Data

(60) Provisional application No. 61/855,279, filed on May 13, 2013.

(51) Int. Cl.

| | |
|---|---|
| ***A47G 19/22*** | (2006.01) |
| ***B65D 6/16*** | (2006.01) |
| ***B65D 8/00*** | (2006.01) |
| ***B65D 21/08*** | (2006.01) |
| ***B65D 81/38*** | (2006.01) |
| ***B65D 47/08*** | (2006.01) |

(52) U.S. Cl.

CPC ..... *B65D 21/086* (2013.01); *A47G 19/2205* (2013.01); *A47G 2019/2277* (2013.01); *B65D 81/3869* (2013.01); *B65D 47/0895* (2013.01); *A47G 19/2288* (2013.01)

(58) Field of Classification Search

CPC .... B65D 21/086; B65D 21/08; B65D 21/068; B65D 1/0292; B65D 11/1873; B65D 81/3869; A45F 3/20; A45F 2003/025; A47G 19/22

See application file for complete search history.

(56) References Cited

U.S. PATENT DOCUMENTS

| | | | |
|---|---|---|---|
| 640,418 | A | 1/1900 | Royer |
| 879,753 | A | 2/1908 | Eckert |
| 1,020,347 | A | 3/1912 | Follett |
| 1,033,744 | A | 7/1912 | Smith |
| 1,049,199 | A | 12/1912 | Bowman |

(Continued)

OTHER PUBLICATIONS reuseit.com, May 10, 2014, Internet printout: http://www.reuseit.com/travel-mugs-and-cups/flatterware-red-flatterware-collapsible-cup.htm.

(Continued)

*Primary Examiner* — Andrew Perreault
(74) *Attorney, Agent, or Firm* — Todd R. Miller

(57) ABSTRACT

A novel cup is disclosed that may be collapsed and extended to hold cold or hot liquids safely. The cup preferably comprises a telescoping body comprising a plurality of rings of varying outer diameters, each ring having an outer wall and an inner wall forming an air gap therebetween, a leak-proof mechanism comprising an O-ring disposed about one or more rings, and a locking mechanism comprising an annular track disposed about one ring, and a pin disposed about another ring adapted to fit within the track and slideably engage it. The locking mechanism may further comprise a first magnet seated within the air gap of a first ring, and a second magnet seated within the air gap of a second ring, whereby the first and second magnets create a magnetic pull toward one another to help keep the cup in either a collapsed or extended position.

15 Claims, 5 Drawing Sheets

(56) References Cited

U.S. PATENT DOCUMENTS

| | | | | |
|---|---|---|---|---|
| 1,351,412 | A | 8/1920 | Carr | |
| 1,498,672 | A | 11/1921 | Renner | |
| 1,561,509 | A | 4/1925 | Davidson | |
| 1,636,323 | A | 12/1925 | Rand | |
| D219,474 | S | 12/1970 | Gahm | |
| D309,116 | S | 7/1990 | Marshall | |
| 6,006,934 | A | 12/1999 | Skrysak | |
| D550,036 | S | 9/2007 | Holcomb | |
| D682,617 | S | 5/2013 | Miksovsky | |
| 8,544,672 | B2 | 10/2013 | Tate | |
| 8,556,099 | B2 | 10/2013 | Perlman | |
| 8,641,004 | B2 | 2/2014 | Miklas | |
| 8,646,640 | B2 | 2/2014 | Faris | |
| 2011/0248037 | A1 | 10/2011 | Fung | |
| 2012/0145709 | A1* | 6/2012 | Foster, Sr. | 220/8 |
| 2012/0205371 | A1 | 8/2012 | Lee | |
| 2012/0248106 | A1* | 10/2012 | Marta | 220/8 |
| 2013/0032592 | A1 | 2/2013 | Lee | |
| 2013/0264340 | A1 | 10/2013 | Zens | |

OTHER PUBLICATIONS dhgate.com, May 10, 2014, Internet printout: http://www.dhgate.com/product/75ml-stainless-steel-portable-outdoor-travel/162842160.html#s1-1-1|1314308380.

practicaltravelgear.com, May 10, 2014, Internet printout: http://practicaltravelgear.com/gsi-collapsible-coffee-drip-travel-filter/.

izola.com, May 10, 2014, Internet printout: http://www.izola.com/collections/travel-cups.

betacup.jovoto.com, May 10, 2014, Internet printout: https://betacup.jovoto.com/ideas/5031.

magazine.good.is, May 10, 2014, Internet printout: http://magazine.good.is/articles/ditch-the-disposable-cup-8-innovative-reusable-mugs.

mountainhighoutfitters.com, May 10, 2014, Internet printout: http://www.mountainhighoutfitters.com/Products/X-Mug+Collapsible+Mug.html.

zipcup.com, May 10, 2014, Internet printout: http://www.zipcup.com/p/about-zip-cup.html.

* cited by examiner

COLLAPSIBLE CUP FOR HOT AND COLD BEVERAGES

CROSS-REFERENCE TO RELATED APPLICATION

The present application claims benefit of and priority to U.S. Provisional Patent Application Ser. No. 61/855,279 filed on May 13, 2013 entitled "Collapsible Steel Cup for Hot and Cold Beverages," the entire contents of which are hereby incorporated by reference herein.

BACKGROUND

The present disclosure relates generally to cups and more particularly to cups cable of being collapsed and extended to hold both cold and hot beverages safely and effectively.

In the United States alone, it is reported that at least 25 billion coffee cups are thrown away each year, and at least 2.5 million plastic beverage bottles are thrown away every hour. According to one study, each paper cup manufactured is responsible for 0.24 pounds of carbon dioxide emissions. Just one cup of coffee or tea in a disposable cup every day creates about 23 pounds of waste in one year. And when the disposable cup is a made of polystyrene and thrown into a landfill, most if not all of that waste will still be present in that landfill 500 years later.

In an effort to combat this situation and promote a greener Earth, it is becoming more and more common to see an individual carrying their own reusable cup or bottle, a company that no longer provides disposable cups at the coffee station, and coffee or tea shops that promote and sell sustainable cups or provide a discount for bringing your own cup.

Conventional ceramic cups are reusable but suffer from being fragile and incapable of being collapsed and thus unlikely to be placed into a bag or purse and brought with the consumer. While collapsible cups exist, the disadvantages of conventional collapsible cups are many including failing to maintain liquid temperature for a high range of temperatures; collapsing upon receipt of hot liquid; too hot to hold safely upon receipt of hot liquid; counter-intuitive to collapse and/or extend; failing to be leak-proof; and aesthetically unpleasing.

Accordingly, a novel collapsible cup solving the aforementioned problems is therefore desired.

SUMMARY

One exemplary embodiment of the disclosed subject matter is a collapsible cup comprising a first ring having an outer wall and an inner wall forming an air gap slot therebetween, a second ring having an outer wall and an inner wall, and a locking mechanism for collapsing and extending the cup. The locking mechanism preferably comprises a first pin extending outwardly from the inner wall of the first ring, and further comprises a track disposed along the outer wall of the second ring, wherein the track is adapted to engage the pin as the cup is being collapsed and extended. The first ring may further comprise a magnet slot between the inner and outer walls. The second ring may further comprise an air gap slot and a magnet slot between its inner and outer walls, wherein the locking mechanism may further comprise a magnet held within the magnet slot of the first ring, and a magnet held within the magnet slot of the second ring. A leak-proof mechanism comprising an O-ring fit within a groove of each ring may also be employed, along with a lid that includes a flipping mechanism and a mouthpiece. At least the body of the cup is preferably made of stainless steel, making for an aesthetically appealing and sustainable, collapsible cup.

Another exemplary embodiment of the disclosed subject matter is a collapsible cup comprised of a lid and body made up of annular rings. The cup preferably includes a locking mechanism comprising threads on the rings for engaging one another, a lid made of ferretic stainless steel, and a magnet at the cup's base.

BRIEF DESCRIPTION OF THE DRAWINGS

Some non-limiting exemplary embodiments of the disclosed subject matter are illustrated in the following drawings. Identical or duplicate or equivalent or similar structures, elements, or parts that appear in one or more drawings are generally labeled with the same reference numeral, optionally with an additional letter or letters to distinguish between similar objects or variants of objects, and may not be repeatedly labeled and/or described. Dimensions of components and features shown in the figures are chosen for convenience or clarity of presentation. For convenience or clarity, some elements or structures are not shown or shown only partially and/or with different perspective or from different point of views.

DETAILED DESCRIPTION

A general problem in the field of beverage cups is sustainability. A general solution is a sustainable cup that may be reused as long as desired.

A technical problem in the field of beverage cups is collapsibility when not in use and non-collapsibility when in use with a hot liquid. A technical solution implementing the spirit of the disclosed inventions is a cup locking mechanism that quickly and intuitively collapses when not in use and stays extended when in use with a hot or cold liquid.

Potential benefits of the general and technical solutions provided by the disclosed subject matter include a novel cup that is insulative and maintains liquid temperatures for a high range of temperatures, while also being safe to hold and leak-proof. Additional benefits also include an aesthetically pleasing cup that can be collapsed and carried in a bag or purse by a consumer whenever and wherever desired.

A general non-limiting overview of practicing the present disclosure is presented below. The overview outlines exemplary practice of embodiments of the present disclosure, providing a constructive basis for variant and/or alternative and/or divergent embodiments, some of which are subsequently described.

Figure 1:
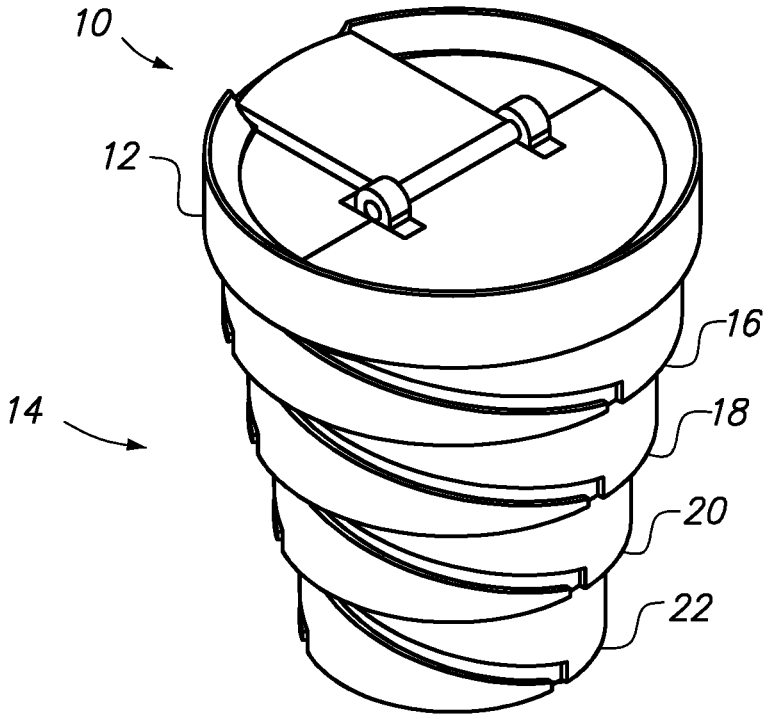
FIG. 1 is a perspective view of a collapsible cup according to an embodiment of the inventions disclosed herein, illustrating the cup in an extended fashion ready for use.

FIG. 1 is a perspective view of a collapsible cup according to an embodiment of the inventions disclosed herein, illustrating the cup in an extended fashion ready for use. Turning in detail to FIG. 1, the collapsible cup 10 is preferably comprised of a lid 12 and cup body 14. The lid 12 and/or body 14 are preferably made out of stainless steel and most preferably Type 304 stainless steel with an 18/10 grade. The cup body 14 may be comprised of one or more rings, such as rings 16, 18, 20, and 22 seen in FIG. 1. The rings 16, 18, 20, and 22 are of varying outer dimension, wherein ring 16 is larger in diameter than ring 18, which in turn is larger than ring 20, which in turn is larger than ring 22, whereby the cup 10 is telescopically extendable and collapsible upon itself. When collapsed, the preferred dimensions of the collapsed cup 10 are some 3.4" in diameter and some 1.8" tall without the lid 12. With these preferred dimensions and four preferred rings 16-22, the cup 10 advantageously will hold 12 ounces of a hot or cold beverage while extended, while also easily fitting into a pocket or purse when collapsed.

Figure 2:
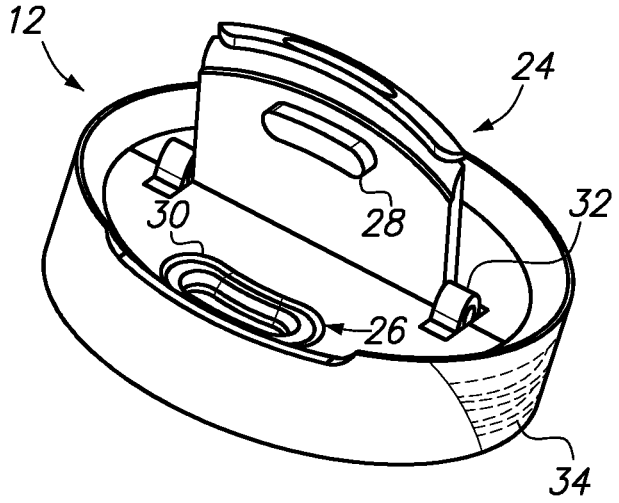
FIG. 2 is a perspective and partial cross-sectional view of the lid of the collapsible cup shown in FIG. 1.

FIG. 2 is a perspective view of the lid 12 shown in FIG. 1. The lid 12 helps prevent leakage and/or keeps a beverage or the like contained within the cup body 14. As seen in FIG. 2, the lid 12 may include a flipping mechanism 24 engageable with a mouthpiece 26 to permit the user to drink from the cup 10 when the flipping mechanism 24 is lifted. The flipping mechanism 24 preferably has a protrusion 28 adapted to fit within mouthpiece 26. To make it easier for a user to lift the flipping mechanism 24 once friction-fit within the mouthpiece 26, the mouthpiece may have annular rings 30 of varying diameter. The flipping mechanism 24 is preferably pivotally mounted to the top of the lid 12 by way of flipping mechanism clips 32. The lid 12 is preferably coupled to the body 14 of the cup 10 via threads 34.

Figure 3:
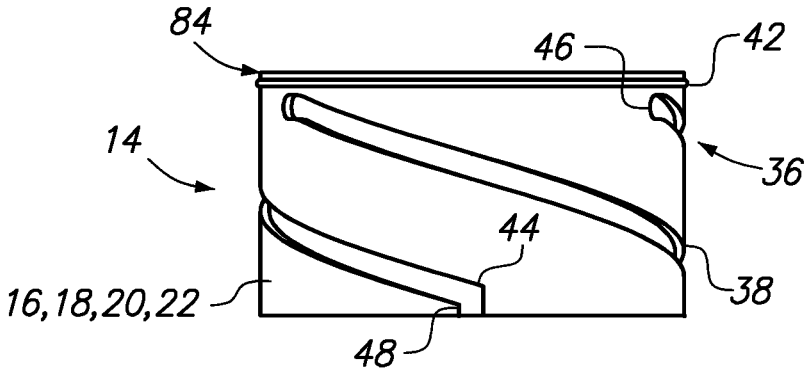
FIG. 3 is a side view of one of the rings shown in FIG. 1.
Figure 3A:
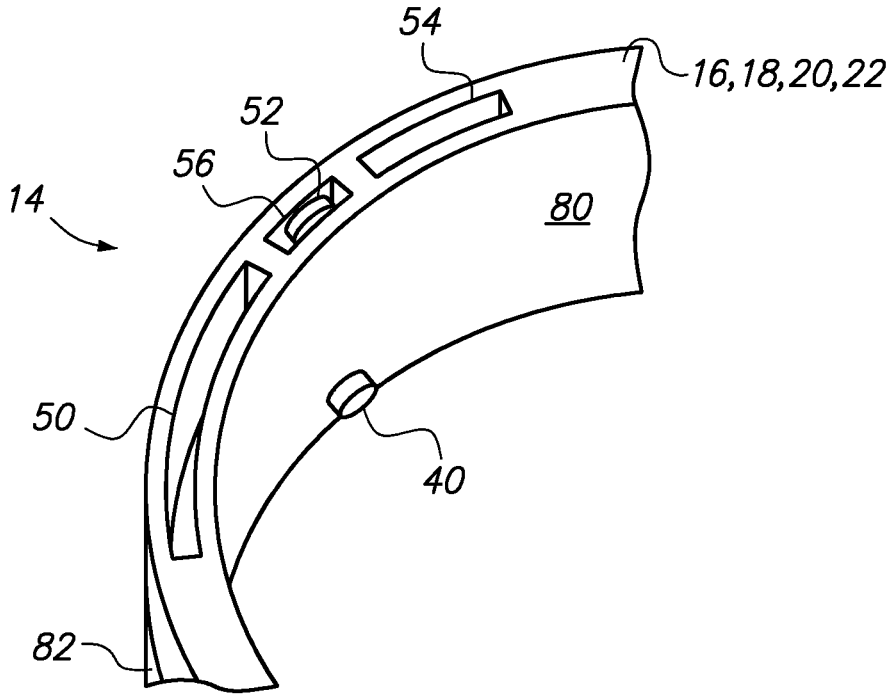
FIG. 3A is a perspective view of one of the rings shown in FIG. 1.

FIGS. 3 and 3A illustrate a preferred locking mechanism 36 for collapsing and expanding the cup. As shown there, the locking mechanism 36 comprises a slot or track 38 and pin 40 arrangement and may further comprise magnets, such as magnet 52. The track 38 and pin 40 arrangement provide a fail-safe mechanism so if a strong force was to be applied to the top of the cup 10, it would not immediately collapse. The magnets are also intended to lock the cup 10 in expanded and collapsed positions. The locking mechanism may alternatively comprise threads 110 on rings 108 and/or a magnet 114 that is attracted to a ferretic stainless steel lid 102, such as the embodiment shown in FIGS. 5A-5D.

Figure 4:
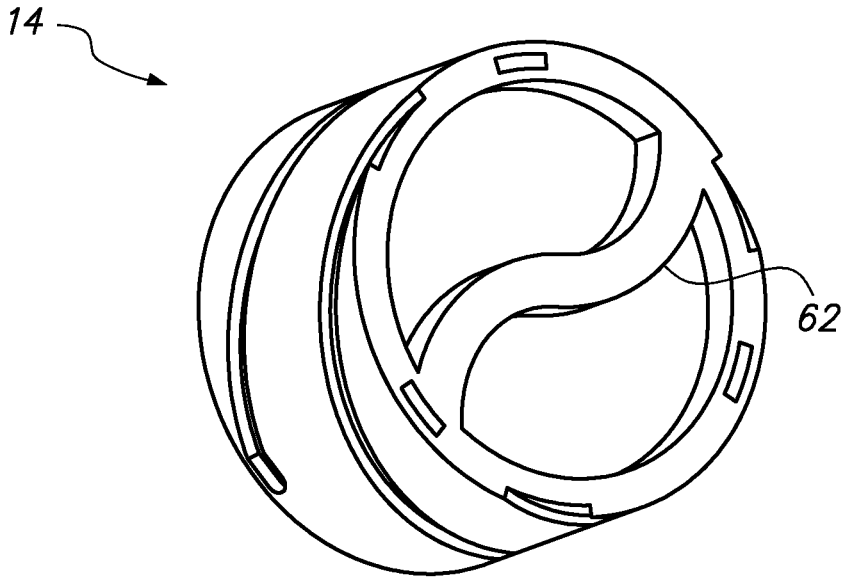
FIG. 4 shows a grip handle that may be used at the bottom of the collapsible cup shown in FIG. 1.

Turning again to FIGS. 3 and 3A, to extend the cup 10, a user need simply rotate the bottom ring 22 while holding the lid 12 in place, for example. More preferably, the user grips a handle at the bottom of the cup 10 for twisting. The handle 62 may comprise a "yin-yang" tab such as that seen in FIG. 4 or equivalent design such as a bowling grip, finger cut-outs, pop-up handle, or pop-up pin. When the handle 62 is gripped and turned clockwise, the pin 40 moves along slot 38 from a pin starting point 44 until a pin ending point 46. This action may occur with each pin-slot arrangement. For example, a pin 40 associated with ring 20 moves along slot 38 in ring 22 until it hits the pin end point 46 there; while a pin 40 associated with ring 18 moves along slot 38 in ring 20 until it hits the pin end point 46 there. To collapse the cup 10, a user need simply grip the handle 62 and rotate counter-clockwise. The motion that collapses the cup 10 could cause it to disassemble if the shear force of the magnets 52 were to be overcome. To fix this problem, the slot 38 preferably includes a pin exit track 48 extending downward at a vertical angle from the pin starting point 44, as seen in FIG. 3. The pin exit track 48 requires the user to remove the rings 16, 18, 20, and 22 consciously, rather than accidentally, for disassembly such as when the user desires to wash the cup 10.

Figure 3B:
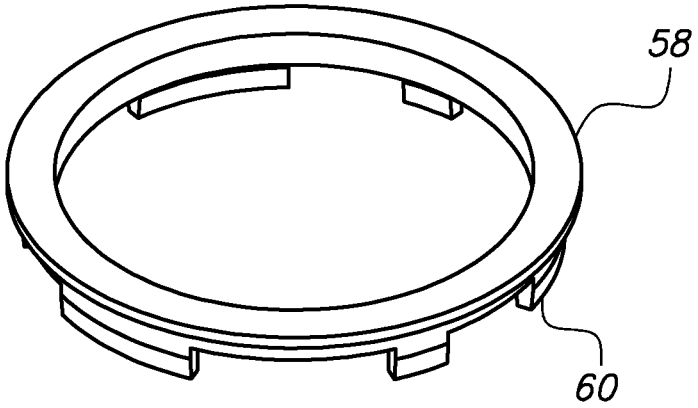
FIG. 3B is a ring top that may be used in conjunction with one of the rings shown in FIG. 1.

As seen in FIG. 3A, an air gap slot 50 is disposed between the inner 80 and outer walls 82 of each ring 16, 18, 20, and 22 of the cup 10 to help insulate the cup 10 and also increase safety for the user. To elaborate, assuming that a conventional, single-walled cup contains hot coffee at a constant temperature of 180° F., the outside wall temperature of a conventional cup may be 170° F. for a plastic material such as polypropylene, and 179.9° F. for stainless steel. As the threshold for pain to humans is typically around 120° F., a conventional cup may be considered too hot to be safe for the consumer in this instance. In contrast, the novel cup 10 disclosed herein with dual walls and air gap 50 therebetween advantageously results in an outside wall temperature of some 99° F. even though the cup 10 itself holds hot coffee at a constant temperature of 180° F. The dual walls with air gap therebetween also advantageously create a magnet slot 56 to embed a magnet 52 therein to keep it contained. The cup 10 preferably comprises six magnets 52 per ring 16, 18, 20, 22 wherein three magnets 52 are disposed at the top and three are disposed at the bottom. Each magnet 52 is preferably a ¼"×¼"×1/16" rare earth magnet in a Neodymium block with a pull force of 2.7 lbs. To minimize the wall thickness in the disclosed cup 10, the air gap slot 50 preferably sits in between each slot 38 near or about each pin ending point 46. To close the air gap, a press fit ring top 58 with press fit engagement protrusions 60 engage the air gap slot 50, magnet slot 52, and press fit slot 54, as seen in FIGS. 3A and 3B.

Turning once again to FIG. 3, the disclosed cup 10 also advantageously has a leak-proof dynamic seal. To create this seal, cup 10 preferably includes an O-ring, such as O-ring 42, held within a groove 84 at the top of each ring 16, 18, 20, and 22. The O-ring may be machined aluminum rings, silicon rings, or the like.

Figure 5A:
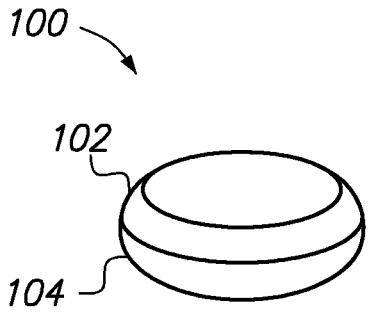
FIGS. 5A-5D are perspective views of a collapsible cup according to another embodiment of the inventions disclosed herein, with FIG. 5A illustrating the cup in a collapsed and closed fashion, FIG. 5B illustrating how the cup is twisted counter-clockwise to extend it, FIG. 5C illustrating the cup in a fully extended fashion ready for use, and FIG. 5D illustrating how the cup is twisted clockwise to collapse it.
Figure 5B:
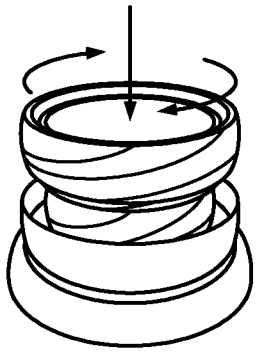
Figure 5C:
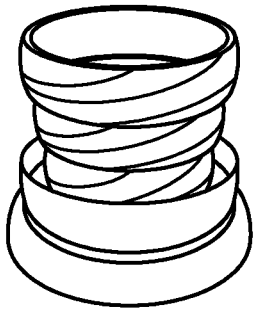
Figure 5D:
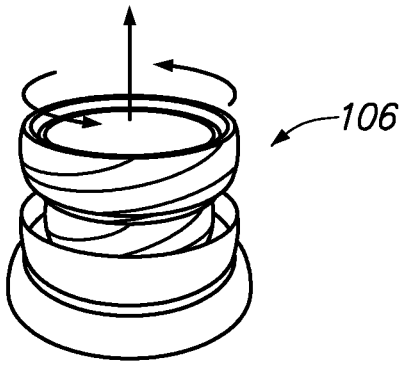
Figure 6A:
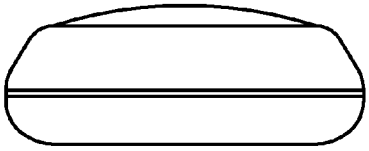
FIGS. 6A-6F are perspective views showing one or more aspects of the cup shown in FIGS. 5A-5D in more detail.
Figure 6B:
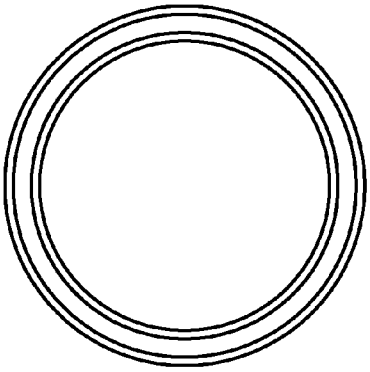
Figure 6C:
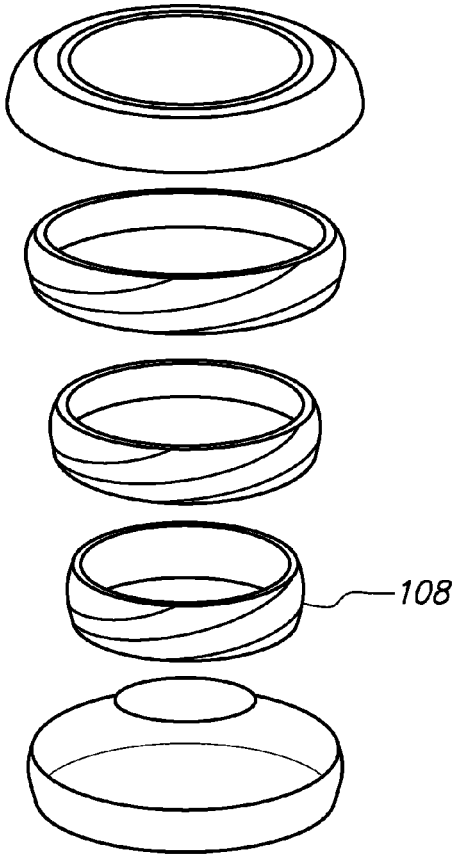
Figure 6D:
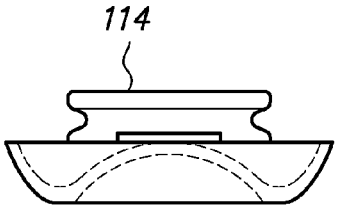
Figure 6F:
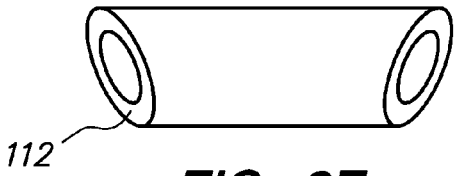
Figure 6E:
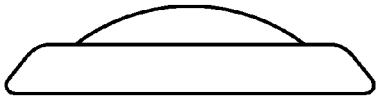
Figure 6F:
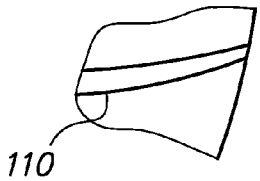

An alternative embodiment to the cup 10 disclosed in FIGS. 1-4 may be seen in FIGS. 5A-6F. In particular, FIG. 5A illustrates a collapsed and closed cup 100 comprised of a lid 102 and base 104. The lid 102 and base 104 are preferably made of stamped stainless steel, with the lid 102 most preferably made of ferretic stainless steel. The body 106 of cup 100 may be comprised of one or more annular rings 108, as seen in FIG. 6C, having tapered threads 110. Each ring 108 is preferably investment cast, polished threaded to its mating ring 108, and then hammered to lock the rings 108 together. The bottom ring 108 is preferably welded to the base 104, sandwiching the magnet 114 therebetween. In operation, the user exerts enough shear force to overcome the magnetic attraction between the magnet 114 and lid 102 and then continues to twist counter-clockwise to extend, as seen in FIG. 5B. FIG. 5C shows the cup 100 in a fully extended state. To collapse the cup 100, the user twists clockwise, as seen in FIG. 5D, until the fully closed position seen in FIG. 5A. Similar to the cup 10 disclosed above, the cup 100 preferably includes an air cavity for insulative and safety reasons, such as air cavity 112 disposed within each ring 108 seen in FIG. 6F.

While certain embodiments have been described, the embodiments have been presented by way of example only and are not intended to limit the scope of the inventions. For example, from the above disclosure, it will be apparent to one of ordinary skill in the art to configure any of the cups 10, 100 disclosed herein to collapse by turning counter-clockwise and extend by turning clockwise. By way of further example, instead of the preferred "S" lock pin and slot configuration disclosed above, an "L" lock or "C" lock pint and slot configuration could be employed. Indeed, the novel devices described herein may be embodied in a variety of other forms; furthermore, various omissions, substitutions, and changes in the form of the devices and methods described herein may be made without departing from the spirit of the inventions. The accompanying claims and their equivalents are intended to cover such forms or modifications as would fall within the scope and spirit of the inventions.

The invention claimed is:

1. A collapsible cup comprising:

a first ring having an outer wall and an inner wall comprising an air gap slot therebetween;

a second ring having an outer wall and an inner wall; and a locking mechanism for collapsing and extending the cup, wherein the locking mechanism comprises a first pin extending outwardly from the inner wall of the first ring, and further comprises a track disposed along the outer wall of the second ring, wherein the track is adapted to engage the pin as the cup is being collapsed and extended; wherein the first ring further comprises a magnet slot between the inner and outer walls of the first ring, and wherein the second ring further comprises an air gap slot and a magnet slot between the inner and outer walls of the second ring, and wherein the locking mechanism further comprises a magnet held within the magnet slot of the first ring and a magnet held within the magnet slot of the second ring.

2. The cup of claim 1, wherein the first ring further includes a groove cut within its outer wall, and further comprising an O-ring fit within the groove, whereby a leak-proof seal is created between the first and second rings.

3. The cup of claim 1, wherein the track includes a pin starting point, a pin ending point, and a pin exit, wherein the pin exit extends downwardly from the pin starting point.

4. The cup of claim 3, wherein the air gap slot is disposed near the pin ending point.

5. The cup of claim 1, further comprising a ring top adapted to cover and engage the air gap slot of the first ring.

6. The cup of claim 1, further comprising a lid adapted to cover and engage the first ring, wherein the lid comprises a flipping mechanism and a mouthpiece.

7. The cup of claim 1, wherein the first and second rings are made of stainless steel.

8. The cup of claim 1, wherein the lid is made of ferretic stainless steel, and further comprising a magnet adapted to engage the lid and keep the cup closed when collapsed.

9. The cup of claim 1, wherein the cup has a top and a bottom, and further comprising a lid at the top and a grip handle at the bottom.

10. A collapsible cup comprising:

a lid;

a telescoping body comprising a plurality of rings of varying outer diameters, each ring including a first ring and a second ring of the plurality of rings having an outer wall and an inner wall comprising an air gap therebetween;

a leak-proof mechanism comprising an O-ring disposed about each ring of the plurality of rings; and a locking mechanism comprising an annular track disposed about the first ring of the plurality of rings, and a pin disposed about the second ring of the plurality of rings, wherein the pin is configured to fit within the track and slideably engage the track; wherein the locking mechanism further comprises a first magnet seated within the air gap of the first ring, and a second magnet seated within the air gap of the second ring and positioned to attract the first magnet.

11. The cup of claim 10, wherein the track includes a pin starting point, a pin ending point, and a pin exit, wherein the pin exit extends downwardly from the pin starting point.

12. The cup of claim 11, wherein the air gap is disposed near the pin ending point.

13. The cup of claim 12, further comprising a ring top adapted to cover and engage the air gap of the each ring.

14. The cup of claim 10, wherein each ring is made of stainless steel.

15. The cup of claim 10, wherein the cup has a top and a bottom, and further comprising a yin-yang grip handle at the bottom.

* * * * *